US005160135A

United States Patent [19]

Hasegawa

[11] Patent Number: 5,160,135

[45] Date of Patent: Nov. 3, 1992

[54] STICK

[75] Inventor: Shigeji Hasegawa, Chiba, Japan

[73] Assignee: Hasegawa Kagaku Kogyo Kabushiki Kaisha, Yachiyo, Japan

[21] Appl. No.: 680,013

[22] Filed: Apr. 2, 1991

Related U.S. Application Data

[63] Continuation of Ser. No. 281,990, Dec. 9, 1988, abandoned.

[30] Foreign Application Priority Data

Dec. 11, 1987 [JP] Japan ..... 62-313856

[51] Int. Cl.[5] ..... A63B 59/12

[52] U.S. Cl. ..... 273/67 A

[58] Field of Search ..... 273/67 A, 72 R, DIG. 6, 273/67 D, 67 DC, 73 J

[56] References Cited

U.S. PATENT DOCUMENTS

| | | | |
|---|---|---|---|
| 2,334,860 | 11/1943 | Berger | 273/67 A |
| 2,912,295 | 11/1959 | Gardner | 273/DIG. 6 |
| 3,353,826 | 11/1967 | Traverse | 273/72 R |
| 4,059,269 | 11/1977 | Tiitola | 273/67 A |
| 4,084,818 | 4/1978 | Goupil et al. | 273/67 A |
| 4,148,482 | 4/1979 | Harwell, Jr. et al. | 273/67 A |
| 4,537,398 | 8/1985 | Salminen | 273/67 A |
| 4,591,155 | 5/1986 | Adachi | 273/67 A |
| 4,651,990 | 3/1987 | Profit | 273/67 A |

FOREIGN PATENT DOCUMENTS

| | | | |
|---|---|---|---|
| 1026497 | 6/1986 | Canada | 273/67 A |

*Primary Examiner*—Mark Graham
*Attorney, Agent, or Firm*—Browdy & Neimark

[57] ABSTRACT

A stick has a shaft and a blade interal with the shaft. The blade is attached at each of both surfaces of a wooden core material thereof with at least a fiber reinforced plastic plate, respectively, so as to form a pair of puck-striking surfaces. A soft thin film is provided between the plate and the core. The stick is characterized in that at least one of the plurality of fiber reinforced plastic plates has fibers paralleled in one direction and that the blade is provided at an area thereof equivalent to at least a half of the entire length thereof from the tip of a toe thereof with the wooden core material having grains oriented in the direction intersecting with the direction of fibers of the fiber reinforced plastic plate.

1 Claim, 9 Drawing Sheets

STICK

This application is a continuation of application Ser. No. 07/281,990 filed Dec. 9, 1988, now abandoned.

BACKGROUND OF THE INVENTION

1. Field of the Invention

This invention relates to a sticklike playing instrument (hereinafter simply referred to as "stick") for use in the games of ice hockey, cricket and the like, and more particularly to a stick having puck- or ball-striking surfaces reinforced with a fiber reinforced plastic plate. There will be described hereunder a representative stick which is used in a game of ice hockey.

2. Brief Description of the Prior Art

Heretofore, a stick of this type has been used, for example, in the game of ice hockey. The ice hockey stick is an instrument for striking a disk-shaped puck hard with a radical powerful swing and striking back a puck coming at a high speed. Therefore, the ice hockey stick is easily broken. As a result of our study about the consumption of sticks in Japan, it was found that a university student consumed 30 sticks on average in one season and a player who belongs to a company consumed about 100–150 pcs.

Because of the reasons mentioned above, many attempts have been made to improve a stick which was once simply made of wood. As a result, there appeared a stick reinforced with fiber reinforced plastic (FRP), a stick made of aluminum alloy, a stick made of glass fiber, etc. However, a strong stick often became too heavy for ordinary players, whereas a light-weight stick was often insufficient in durability.

Furthermore, since a stick made of metal such as aluminum alloy is susceptible to plastic deformation, there are used many sticks which are formed by attaching glass fiber reinforced plastic (GFRP) plate, carbon fiber reinforced plastic (CRFP) plate, or the like obtained by impregnating a thermosetting resin such as epoxy, polyester, or the like to a cloth fiber such as glass fiber, carbon fiber, or the like and then hardened to both surfaces of a wooden core material. A typical example of this type is disclosed in U.S. Pat. No. 4,537,398.

The wooden core material has grains oriented in the longitudinal direction of a blade. Such wooden core material is covered with a fiber reinforced plastic plate as a reinforcement plate. The fiber reinforced plastic plate is formed of a plurality of vertical and horizontal fibers which are woven together in such a way as that the vertical and horizontal fibers are intersected with each other and which are then impregnated with resin such as epoxy or the like. However, when a stick with such reinforcement is actually used, it becomes clear that such reinforcement as mentioned alone is not sufficient yet. Since grains are oriented in the longitudinal direction of the blade and the thickness of the stick is rather thin considering its length, it hardly bears a puck impact and is easily broken in the direction of its width. Since it has such characteristic as easily broken in the grain direction it is often split finely or torn.

The cloth type fiber reinforced plastic plate has such an advantage as to reinforce both the vertical and horizontal directions simultaneously because the fibers are intersected with each other in the vertical and horizontal directions. On the other hand, it has such a disadvantage as that the tensile force of the fibers are insufficient because the vertical and horizontal fibers are intersected overlapping with each other and undulated in a waveform. Therefore, it has insufficient tensile strength and insufficient elastic modulus in both vertical and horizontal directions and a physical strength thereof is not large enough. In addition, it has such shortcomings as that a repulsive force against flexibility is small and a responding speed for striking back a puck and a puck speed are slow. Moreover, since fibers are intersected overlapping with each other, it is obliged to have an excessive thickness to that extent. Therefore, the quantity of resin required for impregnation becomes larger to that extent and thus becomes heavier, which naturally spoils an easy handling of such stick. In addition, since a stress concentrates on a point where the fibers are intersected with each other, that portion becomes easy to break.

As a prior art for solving the above shortcomings, there is Japanese patent publication No. Sho 61-59149 filed by the applicant of the present application. The feature of this prior art is that fibers are arranged in parallel relation and extended copying along the configuration of a stick at the puck striking side from a puck striking portion to a handle portion.

However, since the front end portion of a stick, i.e., the area in the vicinity of the toe portion of a blade, is away from a grip portion, the bending amount is large at the time when the blade strikes a puck and delay of response is significant. Moreover, it does not offer a satisfactory solution to such kind of a problem as a difficulty in increasing the puck speed.

The present invention was accomplished in order to solve the above-mentioned problems or shortcomings inherent in the prior art.

SUMMARY OF THE PRESENT INVENTION

It is therefore an object of the present invention to provide a stick which is light in its front end portion and easy to play with.

Another object of the invention is to provide a durable stick.

A specific object of the present invention is to provide a stick, in which a rapid response is available even at the area equivalent to at least a half of the entire length of the blade from the toe portion and a puck speed can be increased.

In order to achieve the above objects, there is essentially provided a stick comprising a shaft and a blade integral with the shaft, the blade being attached to each of both surfaces of a wooden core material thereof with at least a fiber reinforced plastic plate, respectively, so as to form a pair of puck-striking surfaces, said stick being characterized in that at least one of said plurality of fiber reinforced plastic plates has fibers paralleled in one direction; and that said blade is provided at an area thereof equivalent to at least a half of the entire length thereof from the tip of a toe thereof with the wooden core material having grains oriented in the direction intersecting with the direction of fibers of said fiber reinforced plastic plate.

BRIEF DESCRIPTION OF THE DRAWINGS

The above and other objects, features and advantages of the present invention will become apparent to those skilled in the art from the following detailed description of a preferred embodiment of the invention with reference to the accompanying drawings, in which.

DETAILED DESCRIPTION OF THE EMBODIMENT

The present invention will be described hereinafter with reference to the accompanying drawings.

FIGS. 1 through 24 show one embodiment of the present invention.

Figure 1:
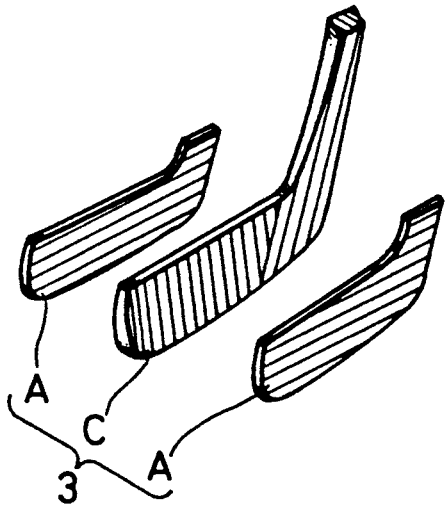
FIG. 1 is an exploded perspective view of one embodiment of a stick of the present invention.
Figure 2:
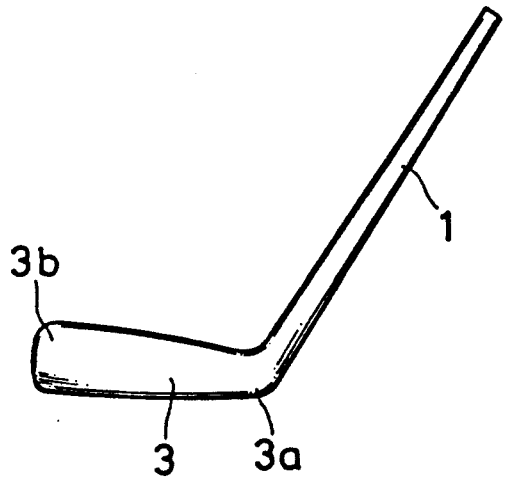
FIG. 2 is a front view of a stick of the present invention.

FIG. 2 shows a stick for use in an ice hockey. The stick comprises a shaft 1 which is grasped by hand and a blade 3 integral with the shaft 1 and adapted to strike a puck. The joint portion between the blade 3 and the shaft 1 is called a "heel" which is denoted by 3*a*. The opposite side of the heel 3*a* on the blade 3 is called a "toe" which is denoted by 3*b*. The blade 3, as shown in FIG. 1, comprises a wooden core material C and at least one fiber reinforced plastic plate A attached to each surface of the material C. The surfaces attached with the fiber reinforced plastic plates serve as puck-striking surfaces. Of the fiber reinforced plastic plates A, at least one is a thin plate which is formed of fibers such as carbon fibers, glass fibers, etc. arranged in parallel relation as such that a tensile force is given in one direction and impregnated with resin of epoxy or esther and hardened. Therefore, it has an excellent resilient property. The amount of a tensile force given depends on the kinds and diameters of the fibers. In case, for example, glass fibers of 2400 g/km are used, the tensile force given is about 0.1~1.51 kg per each fiber.

Figure 12:
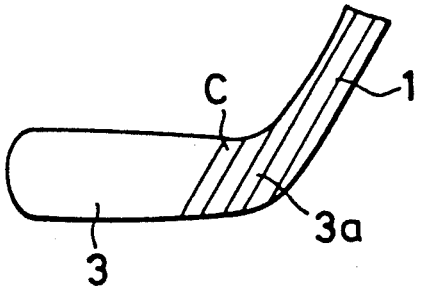
FIGS. 12 and 13 are front views showing an important portion of a stick showing that a part of a shaft member forms a part of a core material of a blade.
Figure 13:
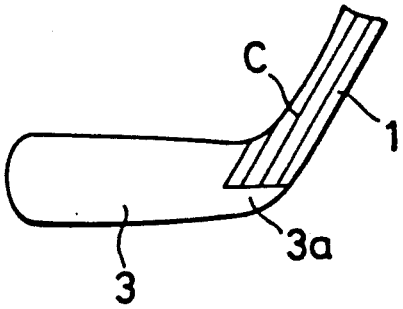

A wooden core material C partly comprises a part of the shaft 1 extending into the heel 3*a* of the blade 3 as shown in FIGS. 12 and 13. In the remainder of the wooden core material C, wood grains are oriented in the width direction (short direction).

In this way, the wooden core material C has an area or portion equivalent to at least a half length of the blade from the tip of the toe 3*b* (equivalent to the entire length of the blade 3 in this embodiment) where grains are oriented in the direction intersecting with the fiber direction of the fiber reinforced plastic plate A.

Figure 3:
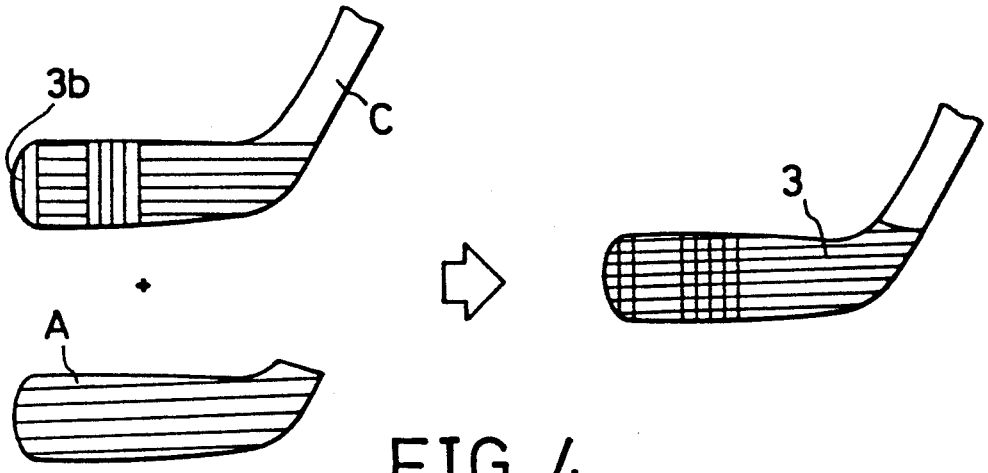
FIGS. 3 through 5 are schematic views showing examples of a wooden core material attached with a fiber reinforced plastic plate.

In FIG. 3, the wooden core material C has a portion where grains are oriented over the entire length in the longitudinal direction of the blade 3 and where grains are oriented generally over a half of the entire length of the blade 3 in the direction vertical to the longitudinal direction of the blade 3. This wooden core material C is attached at each side thereof with a reinforced plate comprising a fiber reinforced plastic plate A in which fibers are arranged in parallel relation in the longitudinal direction. In the area equivalent to a half length of the blade 3 from the tip of the toe 3*b*, the grains of the wooden core material C and the fiber direction of the fiber reinforced plastic plate A are intersected with each other.

Figure 4:
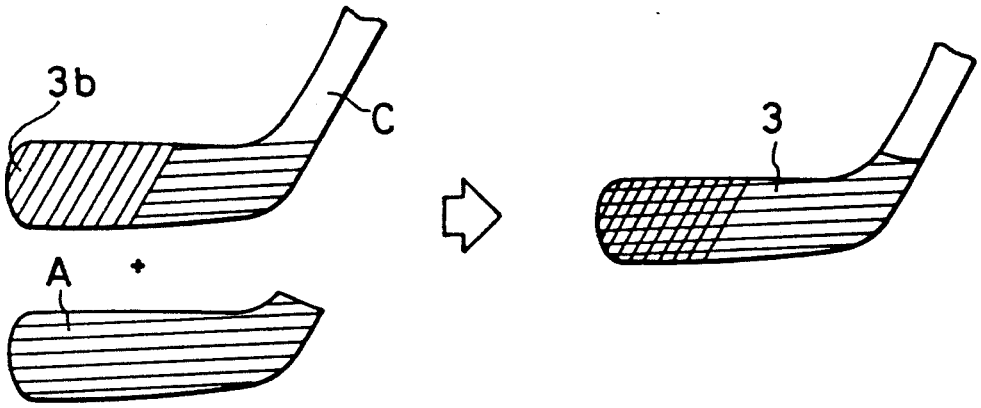

In the example of FIG. 4, an area equivalent to a half of the wooden core material C at the side of the toe 3*b* of the blade 3 is provided with grains oriented at angles with respect to the width direction (short direction) of the blade 3, and the fiber reinforced plastic plate A is provided with fibers arranged in parallel relation in the longitudinal direction of the blade 3 so that the grains and the fiber direction are intersected with each other.

Figure 5:
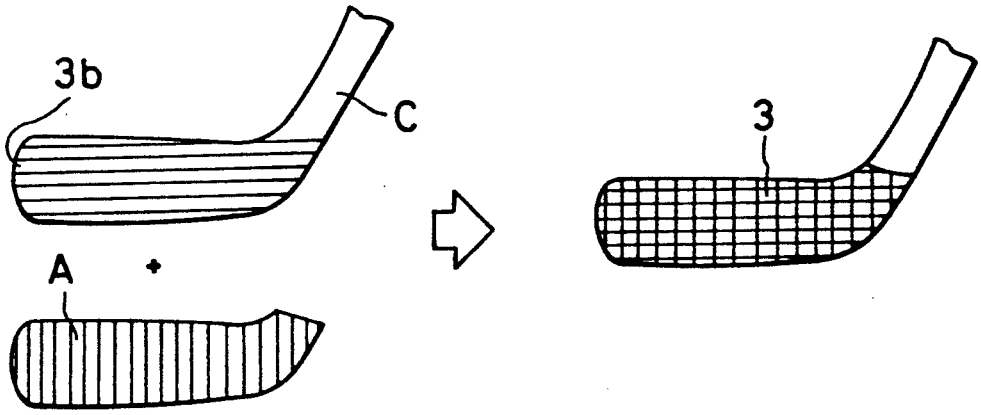

In the example of FIG. 5, the wooden core material C is provided with grains oriented in the longitudinal direction of the blade 3, and the fiber reinforced plastic plate A with the fiber direction arranged in the width direction of the blade 3 is attached to the wooden core material C.

Figure 6:
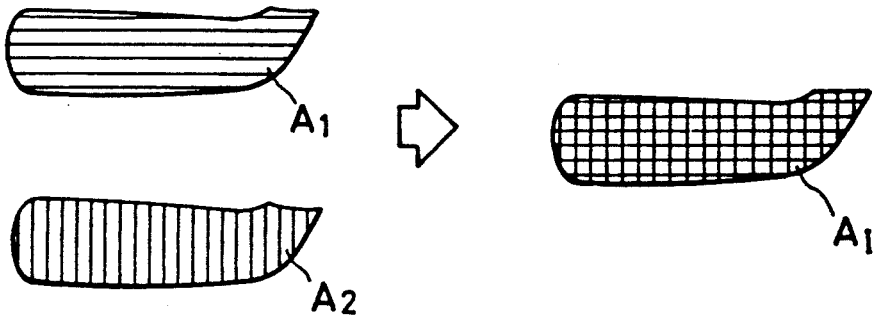
FIGS. 6 and 7 are schematic views showing examples of a plurality of fiber reinforced plastic plates attached with each other.
Figure 7:
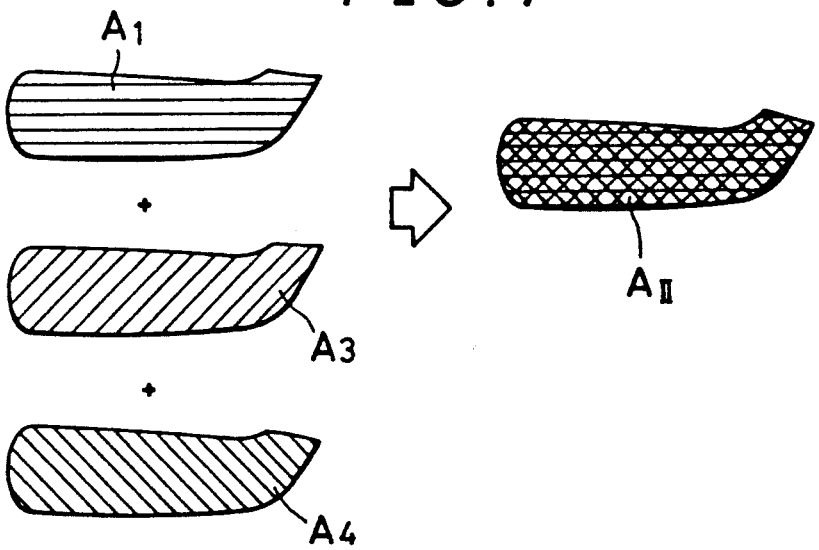

In the examples of FIGS. 6 through 9, the wooden core material C is attached at least at one surface thereof with a plurality of fiber reinforced plastic plates each having fibers arranged in parallel relation in one direction as such that the fiber directions of the plurality of fiber reinforced plastic plates are intersected with each other. FIG. 6 shows a fiber reinforced plastic plate AI comprising a fiber reinforced plastic plate $A_1$ with fibers arranged in parallel relation in the longitudinal direction of the blade 3 and a fiber reinforced plastic plate $A_2$ with fibers arranged in parallel relation in the width direction of the blade 3 and attached with each other. Similarly, FIG. 7 shows a fiber reinforced plastic plate AII comprising three fiber reinforced plastic plates $A_1$, $A_3$ and $A_4$ attached together. In this example, the plate $A_1$ has fibers arranged in parallel relation in the longitudinal direction of the blade 3, the plate $A_3$ has fibers arranged in parallel relation and at angles with respect to the width direction of the blade 3, and the plate $A_4$ has the fibers arranged in parallel relation and at angles with respect to the width direction of the blade 3 but to the other way of the inclining direction of the fibers of the plate $A_3$.

Figure 8:
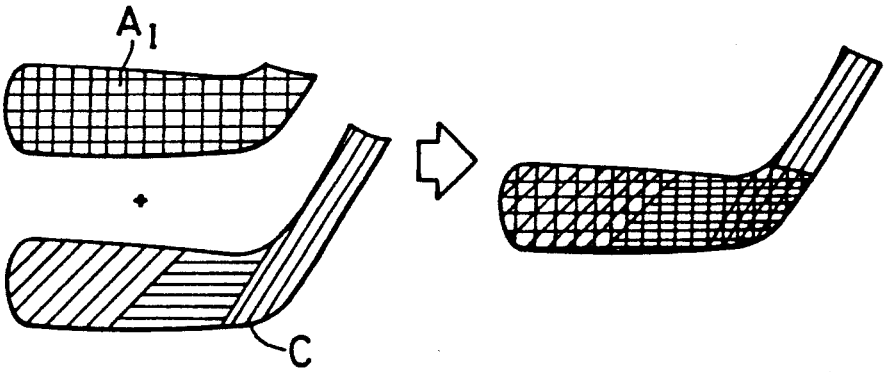
FIGS. 8 through 11 are schematic views showing examples of a wooden core material attached with a plurality of fiber reinforced plastic plates.
Figure 9:
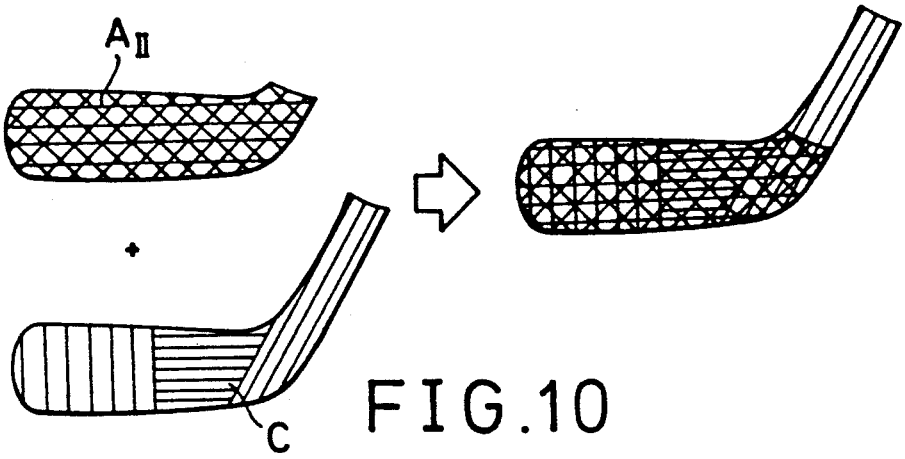

FIG. 8 shows an example in which the fiber reinforced plastic plate AI of FIG. 6 is attached to the wooden core material C having a grain orientation as shown in FIG. 4. FIG. 9 shows still another example in which the fiber reinforced plastic plate AII of FIG. 7 is attached to the wooden core material C having a grain orientation resembling to that of FIG. 3. In this example, only one surface of the wooden core material C is shown. The other surface of the wooden core material C may be attached with the same fiber reinforced plastic plates AI and AII or with the reinforced plastic plate A comprising one reinforced plastic plate. By attaching a plurality of reinforced plastic plates having different fiber directions together, the surfaces of the blade 3 becomes strong and the directionality of the blade 3 against repulsion is lessened. Thus, a player with this type of stick can easily pass a puck in the direction as he wants.

Figure 10:
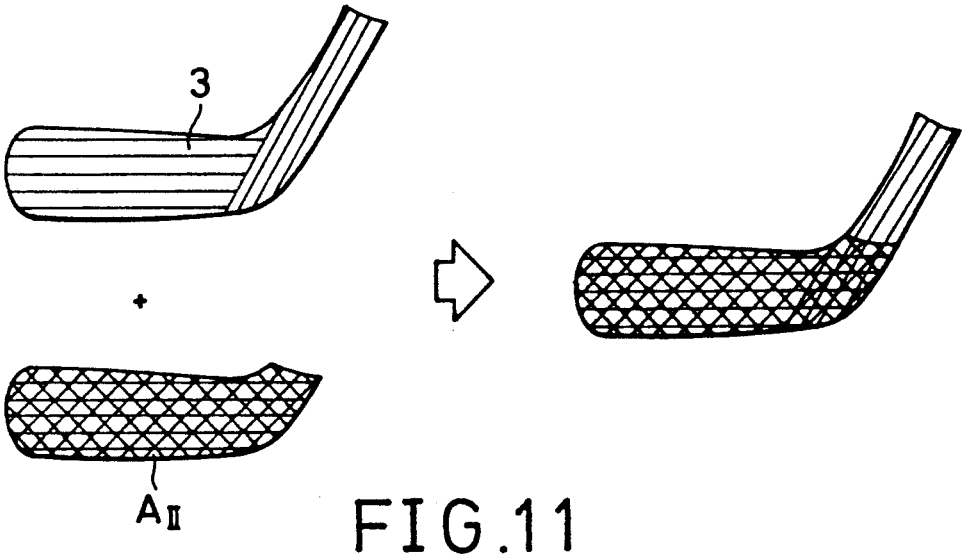
Figure 11:
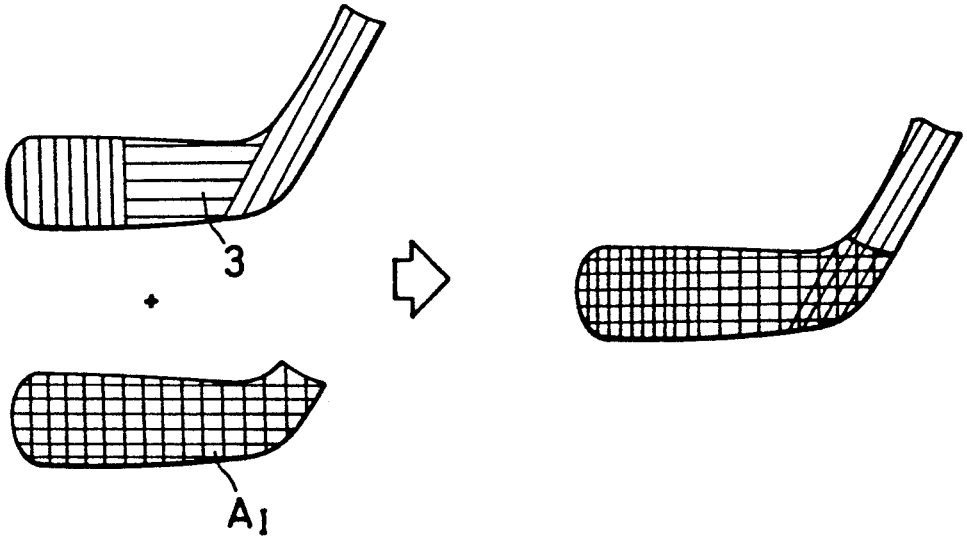

In the example shown in FIG. 10, the wooden core material C having grains oriented in the longitudinal direction of the blade 3 is attached with the fiber reinforced plastic plate AII of FIG. 9. In the example of FIG. 11, the wooden core material C having grains oriented in the width direction of the blade 3 in the area equivalent to a half of the blade 3 at the side of the toe 3*b* is attached with the fiber reinforced plastic sheet AI of FIG. 6. As appreciated from these examples, the core material C has an area equivalent to at least a half length of the blade 3 from the tip of the toe 3*b* where the grains of the wooden core C are oriented in the direction parallel to the fiber direction of any one of the plurality of fiber reinforced plastic plates AI and AII. In this way, since the fiber reinforced plastic plates AI and AII have the fiber direction parallel to the grain direction of the wooden core material C, the shortage of strength of the grains can be offset. In the examples of FIGS. 10 and 11 where fibers are arranged in the longitudinal direction of the blade 3, the repulsive force against flexibility becomes much better when compared with a case solely depended on the wood grains.

Figure 14:
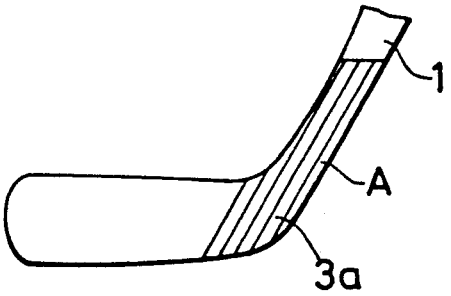
FIGS. 14 through 17 are front views showing an important portion of a stick which is partly reinforced with a fiber reinforced plastic plate.
Figure 15:
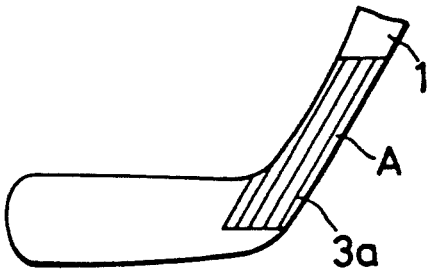
Figure 16:
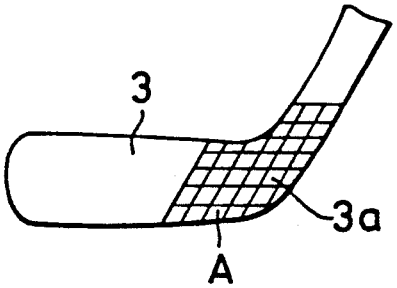
Figure 17:
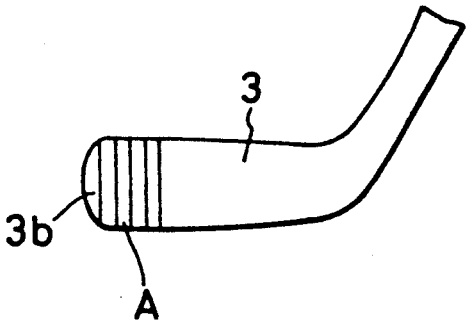
Figure 18:
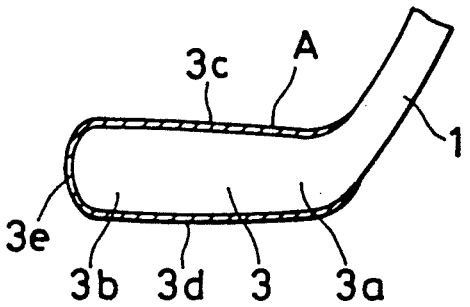
FIG. 18 is a sectional view of a stick with its blade edge covered with a protection material.

FIGS. 14 through 18 show examples in which the fiber reinforced plastic plate is partially attached to any area of the stick which requires a more strength, i.e., the area not limited to the puck-striking surface. In FIGS. 14 and 15, the fiber reinforced plastic plate is disposed to the area extending from the heel 3*a* to the lower portion of the shaft 1 as such that fibers are oriented parallel with the longitudinal direction of the shaft 1. FIG. 16 shows still another example in which a fiber reinforce plastic plate comprising a plurality of fiber reinforced plastic plates having fibers arranged in parallel relation in one direction and overlapped with each other as such that the fiber directions are intersected with each other is disposed to the heel 3*a* portion for a partial reinforcement. In the example of FIG. 17, the toe 3*b* portion is provided for the purpose of a partial reinforcement with the fiber reinforced plastic plate A having fibers arranged in parallel relation in the width direction of the blade 3. In the example of FIG. 18, the blade 3 is provided at an upper surface 3*c*, a lower surface and a front end face 3*e* of the toe 3*b* with the fiber reinforced plastic plate in order to reinforce the peripheral portion of the blade 3. This fiber reinforced plate may be comprised of a single plate or a plurality of plates. The fiber reinforced plate may be provided at least to the lower surface 3*d* of the blade 3.

Figure 19:
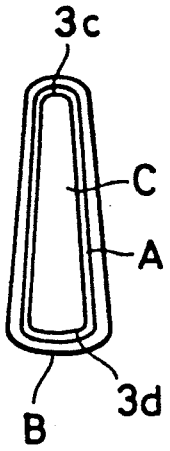
FIG. 19 is a sectional view in the width direction of a blade member, the entirety of which is covered with a protection material.
Figure 20:
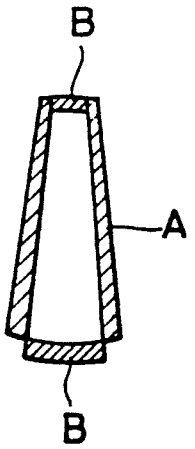
FIGS. 20 and 21 are sectional views similar to FIGS. 20 and 21 but the blade member is partly covered with a protection material.
Figure 21:
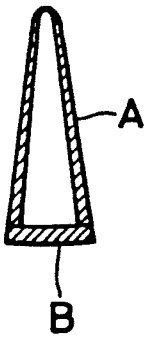

FIG. 19 is a cross sectional view of the blade 3 which is covered at the puck-striking surfaces and peripheral portion thereof with a fiber reinforced plastic plate A and then covered thereon with a layer of a protecting material B such as, for example, a resin. This example is adapted to improve the hardness of the surface of the fiber reinforced plastic plate A and the weakness against a shock. With the projecting material B covering the entire periphery of the blade 3, there can be prevented the invasion of moisture into the core wood, thereby to improve the durability. The protecting material B attached to the puck-striking surfaces is adapted to protect the fiber reinforced plastic having fibers oriented in one direction and thus readily cracked by shock of a puck, etc. The protecting material B applied to the bottom side of the blade 3 is adapted to protect the fiber reinforced plastic which is otherwise readily broken because the bottom side of the stick hits the ice surface very hard when striking the puck. The application of the layer of the protecting material B is not limited to the entire peripheral portion, but it may be applied only to the lower surface 3*d* or only the upper and lower surfaces 3*c* and 3*d*. In this way, in case the protecting material B is provided to the lower surface 3*d* instead of the puck-striking surface, it should be of a special structure such as, for example, those shown in FIGS. 20 and 21 so that the fiber reinforced plastic plate is not pealed off which is caused by interference of the fiber reinforced plastic plate as a reinforcement material due to deformation by sock of the protecting material B or the like. Furthermore, the protecting material B may be provided on a surface in the puck-striking direction with an irregularity such as a projection, a linear projection, an aperture, etc., so as to improve the gripping of the puck.

Figure 22:
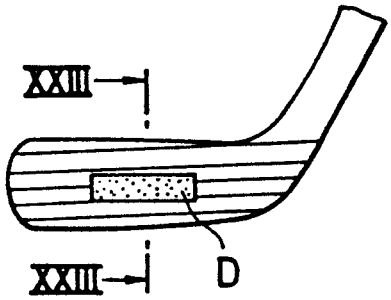
FIG. 22 is a front view of an important portion of a stick having a strike reinforcement member in which grains and/or fibers are oriented in the direction vertical to a puck-striking surface.
Figure 23:
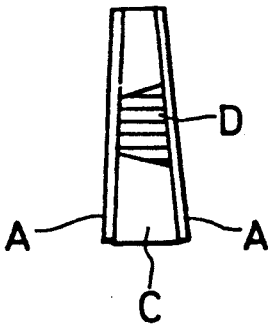
FIG. 23 is a sectional view taken on line XXIII—XXIII of FIG. 22.
Figure 24:
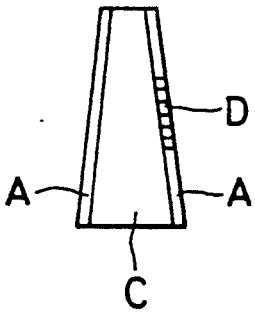
FIG. 24 is a sectional view showing another example at the same position of FIG. 23.

Furthermore, FIGS. 22 through 24 show other examples in which at least a part of the puck-striking surface of the blade 3 is provided with a strike reinforcement member D having wood grains and or fibers oriented in the direction vertical to the puck-striking surface. The strike reinforcement member D may be comprised of the wooden core material C having grains oriented in the direction vertical to the puck-striking surface as shown in FIG. 23, or of the fiber reinforced plastic plate A provided at a part thereof with fibers oriented in the direction vertical to the puck-striking surface as shown in FIG. 24, or of the both members. By virtue of the foregoing arrangement, the striking strength per unit area becomes comparativele large and the repulsive force against a puck also becomes comparatively large, and the puck speed becomes fast, too.

Figure 25:
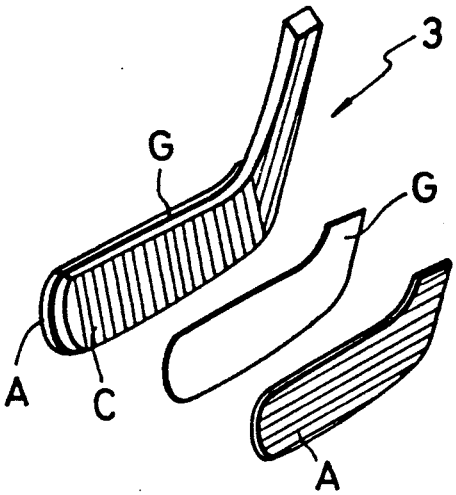
FIG. 25 is an exploded perspective view of a stick with a soft thin film interposed.

FIG. 25 shows an example of a blade in which a undirectional fiber reinforced plastic plate A having its fibers oriented in a longitudinal direction of the blade, is attached to each surface of the wooden core material C through a soft thin film G. The grain direction of the wooden core is oriented in a width direction of the blade. The soft thin film G is formed of a flexible material such as, for example, rubber, soft plastic, etc. The soft thin film is interposed between the attaching surfaces of the wooden core material C and the fiber reinforced plastic plate A in order to effectively prevent the peeling-off of the attaching surfaces. Also, the soft thin film interposed has such a function as to absorb shocks acted on the blade 3. Moreover, it effectively prevents the breakage of the fiber reinforced plastic plate A.

Figure 26:
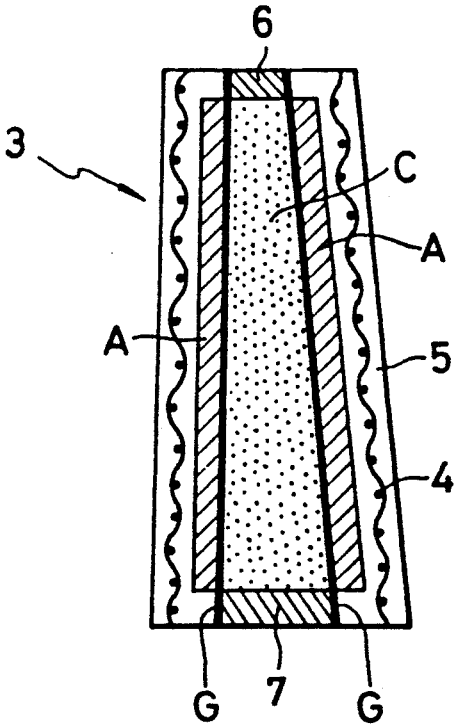
FIG. 26 is a sectional view of a blade including a scatter preventing member.

In the example of FIG. 26, the blade 3 is provided with a scatter prevention member. In the figure, C denotes a core material made of wood. The wooden core material C is provided at its outer side and puck-striking surface with a fiber reinforced plastic plate A reinforced by an inorganic fiber such as carbon fiber, glass fiber or the like which are attached together with a soft thin film G interposed therebetween, respectively. Furthermore, the both outer sides of the wooden core material C is attached with an organic fiber such as nylon, polyester, tetron, aramid or the like adapted to protect the hard and fragile fiber reinforced plastic plate A, or with a soft plastic sheet 5 formed of a scatter prevention member 4 for preventing the scattering of fibershaped substance such as rubber, metal or the like, both surfaces or one surface (both surfaces in the illustrated example) being attached with a thermoplastic. Reference numerals 6 and 7 denote protecting materials for protecting the upper surface or the lower surface of the blade 3 and made of thermoplastic or the like.

In the fiber reinforced plastic plate A of this embodiment, the fibers are not in the form of cloth comprising woven fibers but paralleled by being given a tensile force in one direction. Within a same paralleled plane, fibers are arranged in line at an equal thickness to the size of a fiber and then, for example, a fiber reinforced plastic plate A having a thickness equal to the size of fibers paralleled in a different direction is attached overlapping thereon. The fiber reinforced plastic plate A having fibers paralleled in one direction exhibits a higher resiliency and a higher strength compared with the fiber reinforced plastic plate A having fibers woven in the form of cloth.

This can be proved from the following test data.

STRENGTH TEST OF COMBINATIONS OF REINFORCEMENT MATERIAL AND CORE MATERIAL OF A BLADE

| CORE MATERIAL | KIND GRAIN DIRECTION | ABS RESIN (THICKNESS: 3 mm) | | | | MAPLE WOOD (THICKNESS: 3 mm) HORIZONTAL (LONG. DIRECTION) | | VERTICAL (WIDTH DIRECTION) | |
|---|---|---|---|---|---|---|---|---|---|
| REINFORCED MATERIAL | KIND | CARBON CLOTH | | CARBON PARALLEL | | CARBON CLOTH | | CARBON PARALLEL | |
| | THICKNESS (mm) | 0.23 × 8 = 1.84 | | 0.23 × 8 = 1.84 | | 0.23 × 8 = 1.84 | | 0.23 × 8 = 1.84 | |
| TEST PIECE | CONSTITUTION OF ONE SURFACE | ABS CLOTH CLOTH CLOTH CLOTH | | ABS VERTICAL HORIZONTAL VERTICAL HORIZONTAL | | WOOD CLOTH CLOTH CLOTH CLOTH | | WOOD HORIZONTAL HORIZONTAL VERTICAL HORIZONTAL | |
| | DIMENSION (mm) | 5.9 × 15 × 100 | | 5.9 × 15 × 100 | | 5.9 × 15 × 100 | | 5.9 × 15 × 100 | |
| | WEIGHT (gr) | 9.8 | | 9.8 | | 8.7 | | 8.7 | |
| BENDING TEST RESULT | BENDING RESILIENCE (kg/mm) | BENT 38.0 | BROKEN 38.5 | BENT 46.6 | BROKEN 41.3 | BENT 46.9 | BROKEN 37.0 | BENT 48.6 | BROKEN 36.1 |
| | BENDING STRENGTH (kg) | 120.8 | 120.3 | 177.0 | 172.6 | 129.3 | 111.5 | 150.2 | 138.2 |
| | SPECIFIC STRENGTH (kg/gr) | 12.3 | 12.3 | 18.1 | 17.6 | 14.9 | 12.8 | 17.3 | 15.9 |
| | SPECIFIC RESILIENCE (kg/mm × gr) | 3.9 | 3.9 | 4.8 | 4.2 | 5.4 | 4.3 | 5.6 | 4.2 |

Figure 27:
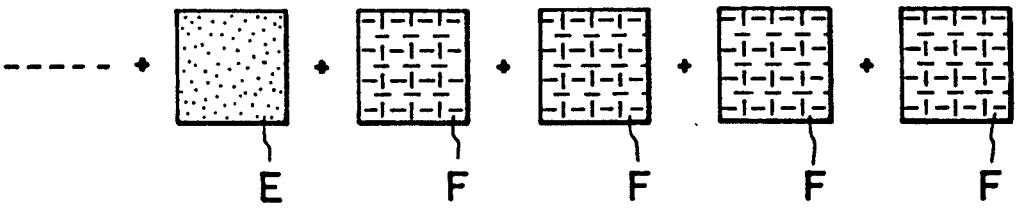
FIG. 27 is a schematic view showing a core material of ABS resin which is being attached with a cloth type carbonic woven cloth fiber reinforced plastic plate.

BENT: Breakage in the width direction
BROKEN: Breakage in the longitudinal direction The content of such test will now be described. (1) Re: Test Piece (1) As shown in FIG. 27, a fiber reinforced plastic plate F comprising four cloth type carbonic woven fiber was attached to each of the both surfaces (one surface is omitted in the illustrated example) of a core material E of an ABS resin (Test piece I).

The vertical and horizontal fiber ratio: the same (1:1)

Figure 28:
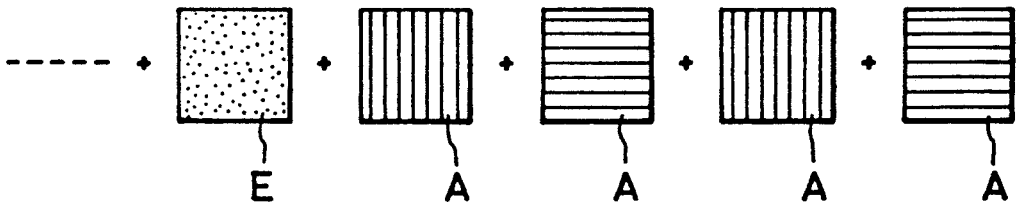
FIG. 28 is a schematic view showing a core material of ABS resin which is being attached with a fiber reinforced plastic plate in which fibers are arranged in one direction.

(2) As shown in FIG. 28, a fiber reinforced plastic plate A comprising four carbon fibers paralleled was attached to each of the both surfaces (one surface is omitted in the illustrated example) of a core material E of an ABS resin (Test piece II).

It is noted that in each test piece I, II, the quantity of the fibers of the fiber reinforced plastic plate F was the same to that of the fiber reinforced plastic plate A.

Figure 29:
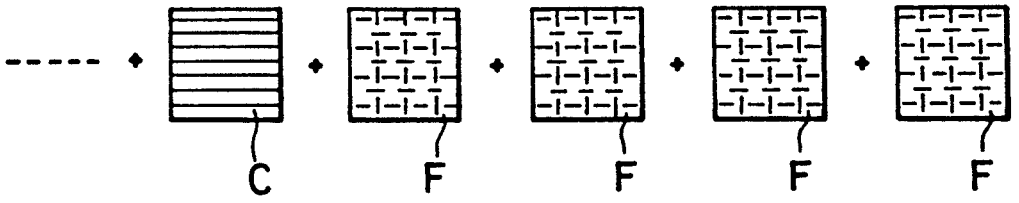
FIG. 29 is a schematic view showing a wooden core material which is being attached with a cloth type carbonic woven cloth fiber reinforced plastic plate.

(3) As shown in FIG. 29, a maple (Acer pictum) was used as the wooden core material C, and wood grains of the material C were oriented in the longitudinal direction of a blade. A fiber reinforced plastic plate F comprising four cloth type carbonic woven fiber was attached to each of the both surfaces (one surface is omitted in the illustrated example) of such prepared core material C (Test piece III).

Figure 30:
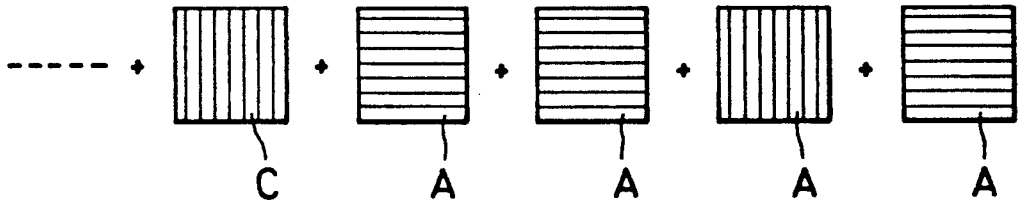
FIG. 30 is a schematic view showing a wooden core material which is being attached with a fiber reinforced plastic plate in which fibers are arranged in one direction.

(4) As shown in FIG. 30, a maple (Acer pictum) was used as the wooden core material C, and wood grains of the material C were oriented in the width direction of the blade. A fiber reinforced plastic plate A comprising four fibers paralleled was attached to each of the both surfaces (one surface is omitted in the illustrated example) of such prepared core material C as such that the number of the horizontal fibers intersecting with the grains is larger than that of the vertical fibers, i.e., horizontal, horizontal, vertical and horizontal (Test piece IV). In case the core material had a directionality as in wood, the reinforcement was performed taking into consideration the directionality of the fiber reinforced plastic plate A.

It is noted that in the test pieces III and IV, the quantity of the fiber reinforced plastic plate F was the same to that of the fiber reinforced plastic plate A.

Figure 31:
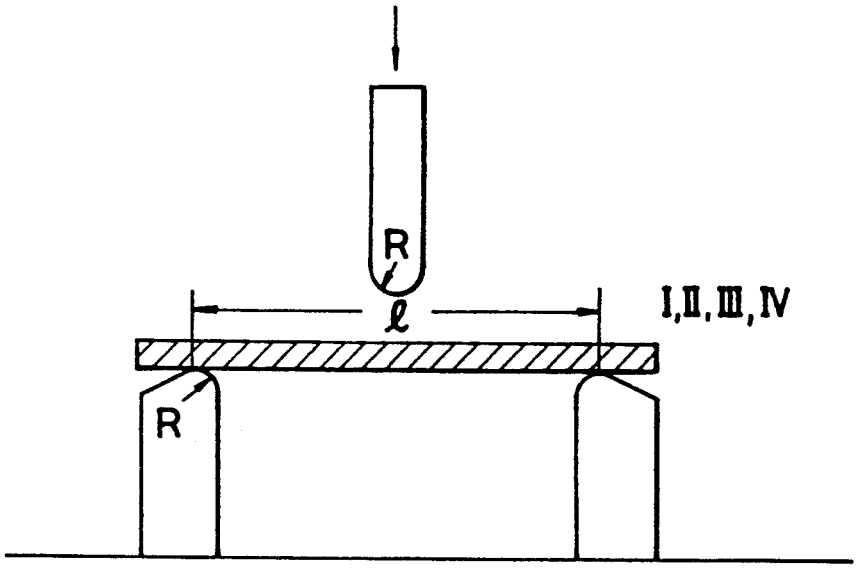
FIG. 31 is a schematic view showing the test conditions.

(2) The test was carried out under the conditions as shown in FIG. 31.

1. The configuration of the test pieces I, II, III and IV Thickness (5.9)×Width (15.0 mm)×Length (100 mm)
2. Load status

| | |
|---|---|
| Testing machine | autograph (Shimazu Seisakusho) |
| Bending chord | three-point bending |
| Span l | 80 mm |
| Radius $R_1$ of pressure element | 5 mm |
| Radius $R_2$ of supporting jig | 2 mm |
| Test speed | 5 mm/min |

The thickness of the test pieces 1 through IV is 3.0 mm for the core materials E and C, and 0.23 mm×8 plates, thus total 3.0+0.23×8=4.84 mm but actually 5.9 since the thickness of the adhesive agent is added thereto, for the fiber reinforced plastic plates A and F.

When the test pieces III and IV are compared with each other, it is known that the quantities of the fiber reinforced plastic plates F and A used are the same, but in the test piece IV, the fiber directions of the fiber reinforced plastic plate A having fibers paralleled in one direction are intersected as horizontal, horizontal, vertical and horizontal also taking into consideration the grain direction of the core material and therefore, the test piece IV is larger in resilience and in strength.

On the contrary, if the strength of both the test pieces III and IV is made the same, the weight of the test piece can be reduced.

In the above table, the specific strength and specific resilience are obtained by dividing the various values with the weights of the test pieces I through IV. In other words, the specific strength and the specific resilience show the strength per weight. Therefore, it becomes lighter and stronger as this value becomes larger.

Such comparison is also applicable to the comparison between the test pieces I and II.

As described in the foregoing, according to the present invention, a half of the entire length of the blade at the toe tip side is reinforced with at least a fiber reinforced plastic plate having fibers parallel in one direction. Accordingly, there can be obtained a stick which is light in its front end and thus easy to play with. Moreover, the repulsive force becomes comparatively large even at the toe tip side of the blade and thus, the striking responsibility is excellent. In addition, the puck speed of the stick can be increased.

While particular embodiments of the present invention have been shown in the drawings and described above, it will be apparent that many changes may be made in the form, arrangement and positioning of the various elements of the combination. In consideration thereof, it should be understood that preferred embodiments of the present invention disclosed herein are intended to be illustrative only and not intended to limit the scope of the invention.

What is claimed is:

1. A puck-striking stick comprising:

a shaft, and a blade; said blade comprising a wooden core integral with one end of said shaft and a pair of puck-striking surfaces formed by attaching at least one unidirectional fiber reinforced cured plastic plate to both sides of said wooden core;

wherein grains of said wooden core are oriented in a width direction of said blade;

wherein fibers of said unidirectional fiber reinforced cured plastic plate are oriented in a longitudinal direction of said blade; and wherein a soft thin film is interposed between said wooden core and said unidirectional fiber reinforced plastic plate.

* * * * *